US006026535A

United States Patent [19]

Lankowski

[11] Patent Number: 6,026,535

[45] Date of Patent: Feb. 22, 2000

[54] TOPICAL SOLUTION APPLICATION APPARATUS

[76] Inventor: Shawn S. Lankowski, 2B McDermott Farm Rd., Danvers, Mass. 01923

[21] Appl. No.: 08/958,759

[22] Filed: Oct. 25, 1997

[51] Int. Cl.[7] ..... A47K 7/02; B05C 1/06

[52] U.S. Cl. ..... 15/209.1; 15/210.1; 15/244.1; 15/244.2; 15/144.1

[58] Field of Search ..... D28/7; 601/118, 601/119, 123, 129, 133, 136, 137; 15/209.1, 210.1, 244.1, 244.2, 144.1, 104.94

[56] References Cited

U.S. PATENT DOCUMENTS

| | | | |
|---|---|---|---|
| 3,568,237 | 3/1971 | Rhodes . | |
| 4,118,824 | 10/1978 | Clement . | |
| 4,299,005 | 11/1981 | Brown . | |
| 4,381,766 | 5/1983 | Avolio . | |
| 4,396,028 | 8/1983 | Waggoner | 15/144.1 |
| 4,483,356 | 11/1984 | Kales . | |
| 4,941,226 | 7/1990 | Kemper | 15/104.94 |
| 5,240,339 | 8/1993 | De Forest et al. . | |
| 5,659,916 | 8/1997 | Beatty | 15/210.1 |
| 5,664,281 | 9/1997 | Pelfrey | 15/244.2 |
| 5,692,261 | 12/1997 | Lops | 15/209.1 |
| 5,842,488 | 12/1998 | Belleau | 15/244.2 |

FOREIGN PATENT DOCUMENTS

| | | | |
|---|---|---|---|
| 2308253 | 8/1974 | Germany | 15/210.1 |

*Primary Examiner*—Randall E. Chin
*Attorney, Agent, or Firm*—Louis J. Franco

[57] ABSTRACT

An topical solution application apparatus for convenient and sanitary application of solutions to body parts is provided. The apparatus includes among its essential elements an elongated body; an elongated arm pivotally attached to the body which is pivotable between extreme extended and retracted positions; an applicator head attached to the arm which is designed to receive and retain an applicator pad; and an applicator container attached to the elongated body for receiving and protecting from contamination the applicator pad retained by the applicator head when the apparatus is not in use.

17 Claims, 6 Drawing Sheets

TOPICAL SOLUTION APPLICATION APPARATUS

FIELD OF THE INVENTION

This invention relates generally to topical solution applicators, and more particularly to a topical solution application apparatus for sanitary and convenient application of topical solutions to human body parts and other surfaces.

BACKGROUND

Persons often have difficulty in properly and adequately applying sun tan lotion, moisturizers or topical solutions and creams to hard-to-reach body parts since the back and shoulders, for example, are not readily accessible without assistance from other persons. Typical ways of applying lotions require that the lotion or cream be placed onto the hands and fingers of a person who must struggle to apply the lotion to hard-to-reach body parts. Such applications frequently are performed on a sandy beach where sand can be entrained into the lotion from the hands and fingers thereby causing irritation, discomfort and potential infection due to unsanitary conditions. Also, application of solutions by this method often does not adequately coat the skin which results in unprotected areas being left exposed to harmful rays of the sun or the chaffing effects of dry, cold air, depending on the purposes for which the lotion is applied.

Although applicator devices have been developed in response to the difficulties and inconveniences associated with applying solutions by hand, no single such device provides sanitary and disposable means for applying such lotions in an apparatus that is compact, ergonomic and versatile and includes the features of the present invention. Furthermore, several of these prior devices are bulky because they include long, non-foldable handles, while still other prior devices rely on complicated lotion dispensing reservoirs which are subject to contamination, malfunction, leakage and waste.

Accordingly, there is a need for a compact, hand held apparatus for convenient, sanitary application of topical solutions that overcomes the limitations of known devices.

SUMMARY

It is an object of this invention to provide a compact, easy-to-use topical solution application apparatus for assisting persons with convenient, sanitary application of topical solutions to their bodies, especially hard-to-reach areas such as the back and shoulders.

It is yet another object of this invention to provide a topical solution application apparatus that has an easily removable applicator pad for cleaning or disposal.

It is a further object of this invention to provide a topical solution application apparatus that contains and protects the applicator pad from contamination from dirt, sand, bacteria or other foreign matter when not in use.

It is yet another object of this invention to provide a topical solution application apparatus that keeps the hands free from contact with solution during application.

Another object of this invention is to provide a topical solution application apparatus that is ergonomically designed to maximize convenience and accessibility to body parts.

It is a further object of this invention to provide a topical solution application apparatus that is portable and foldable and which is furthermore lockable into different positions for versatility.

It is also an object of this invention to provide an apparatus that is simple in design.

In one embodiment, a topical solution application apparatus includes an elongated body having rear and forward ends and an elongated arm having back and front ends, the back end of the arm being pivotally attached to the forward end of the body for movement about its point of attachment to the body between extreme extended and retracted positions, the arm further having an applicator head attached to its front end for retaining an applicator pad. Disposed on the body is an applicator container for receiving and protecting the applicator pad from contamination when the arm is folded into its extreme retracted position. Arm locking means engaging the arm and the body are provided for selectively locking the arm in at least one of its extreme extended or retracted positions and/or at least one position between its extreme extended and retracted positions. The arm locking means may be such that the arm is selectively lockable in various partially extended angular positions between the extreme extended and retracted positions.

In an alternative embodiment, a topical solution application apparatus including features of the preceding paragraph further includes an elongated handle with a first end and a second end. The handle is pivotally connected at its second end to the rear end of the body for pivotal movement between an extreme open position for use and an extreme folded position for storage. Handle locking means cooperate with the handle and the body such that the handle is selectively lockable in at least one of its extreme open or folded positions or a position between its extreme open and folded positions. The handle locking means may be such that the handle is lockable in any of various desired partially open, angular positions between the extreme open and folded positions.

In alternative versions of either of the two preceding embodiments, the applicator head may be attached either fixedly or pivotally to the front end of the arm for versatility.

BRIEF DESCRIPTION OF THE DRAWINGS

Other objects, features, and advantages will occur to those skilled in the art from the following description of an embodiment and the accompanying drawings, in which.

DETAILED DESCRIPTION

Figure 1:
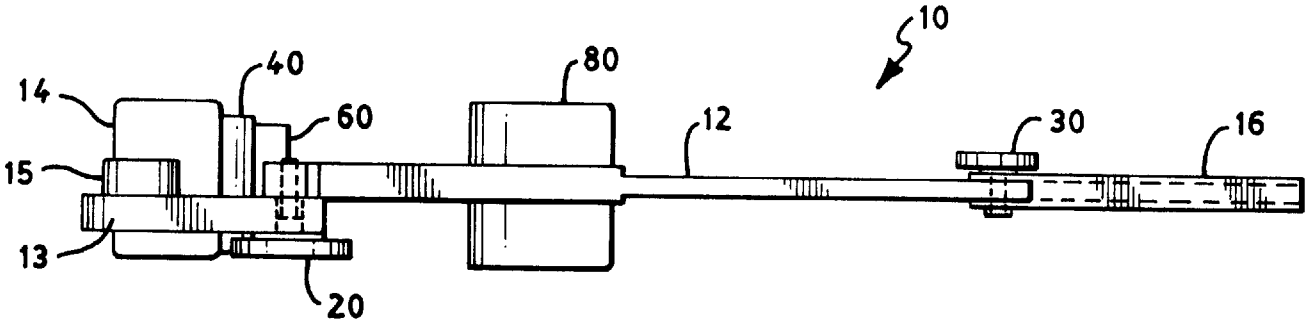
FIG. 1 depicts a top view of an embodiment with its arm in a partially extended position.
Figure 2:
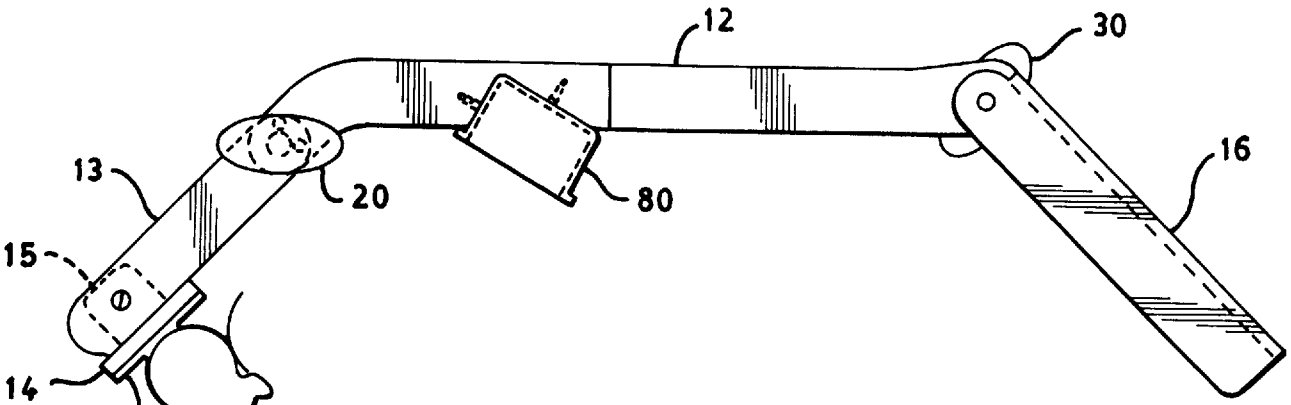
FIG. 2 shows a left side view of the embodiment in FIG. 1 with its arm in a partially extended position.

There is shown in FIGS. 1 through 4 a topical solution application apparatus 10. The topical solution application apparatus 10 comprises an elongated body 12 with rear and forward ends, an elongated arm 13 with back and front ends pivotally attached at its back end to the forward end of the body 12, an applicator head 14 attached to the arm 13 proximate the front end of the arm 13 with a bracket 15 or other suitable attaching means, an applicator clamp 40 mounted to the applicator head 14 for removably receiving an applicator pad 60, a handle 16 with first and second ends which is pivotally attached at its second end to the rear end of the body 12, and an applicator container 80 for receiving and protecting the applicator pad 60 from contamination by foreign matter when the arm 13 is in its extreme retracted position as in FIG. 4. Each of the arm 13 and the handle 16 has means engaging and cooperating with itself and the body 12 for locking it in positions between its extreme positions of travel the details of which are explained later in this description.

To use the application apparatus 10, a user applies a topical solution such as a sun screen, moisturizer, cream or medication to the applicator pad 60 while it is in place within the applicator clamp 40. Grasping the handle 16, the user may conveniently and uniformly apply such solutions to body parts, especially hard-to-reach areas such as the back and shoulders.

Figure 3:
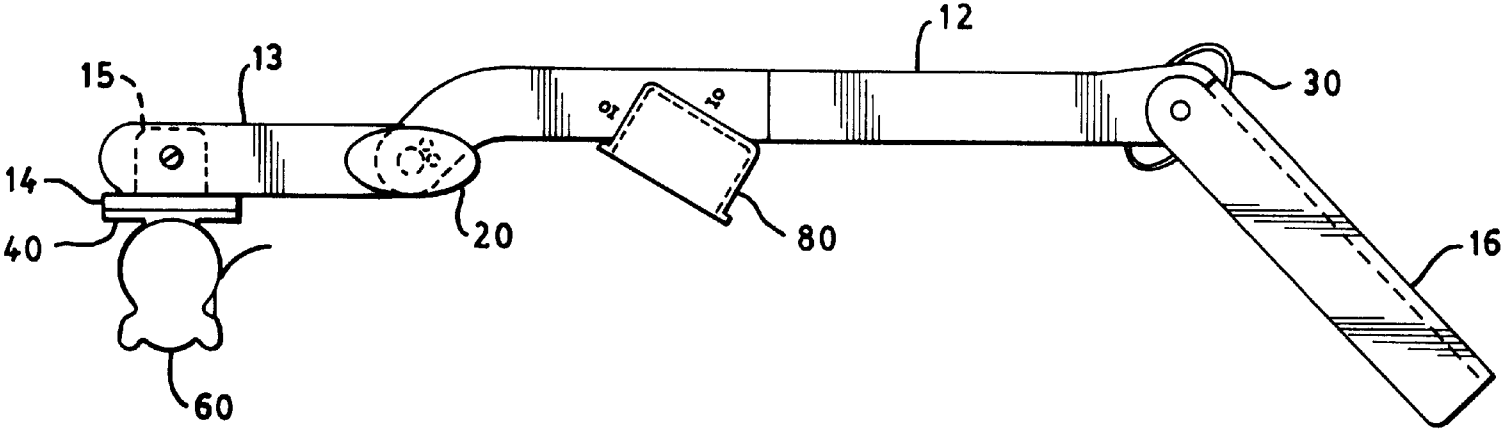
FIG. 3 shows a left side view of the embodiment in FIGS. 1 and 2 with its arm in the extreme extended position and its handle in the extreme open position.
Figure 6:
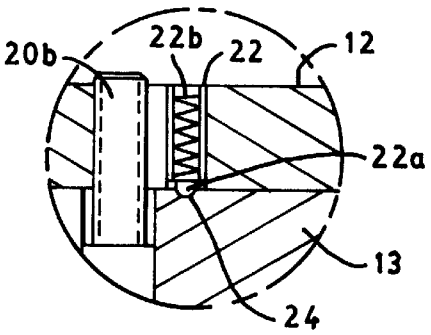
FIG. 6 shows a partial top sectional detail of the arm locking assembly of FIG. 5.
Figure 5:
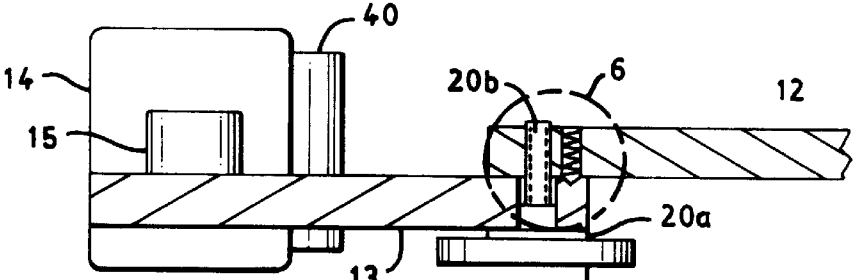
FIG. 5 shows a top sectional view of an arm locking assembly (detail 6)
Figure 7:
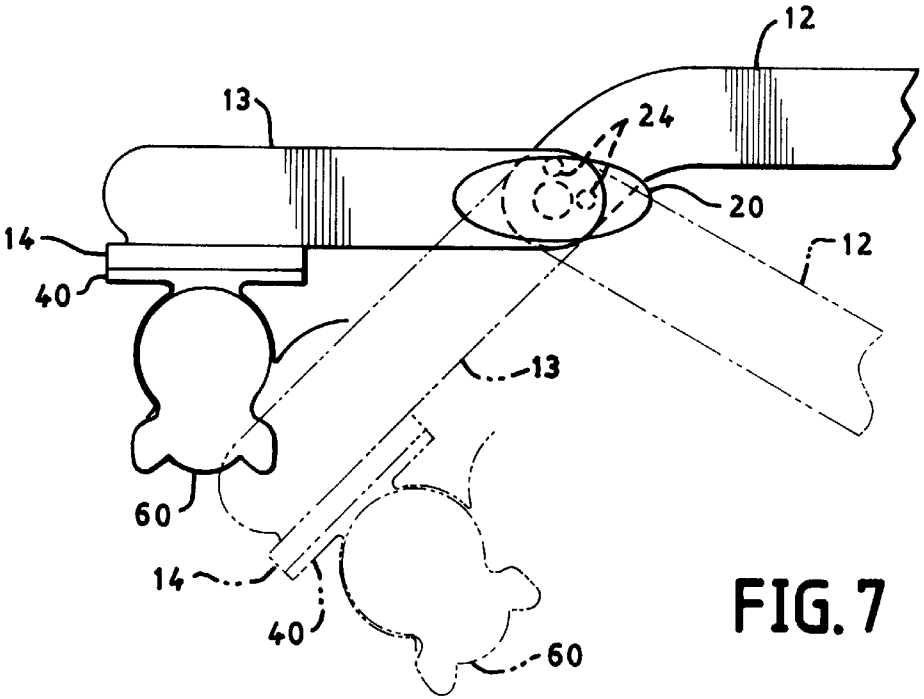
FIG. 7 shows a partial left side, sectional view of the arm locking assembly of FIGS. 5 and 6 with the arm in its extreme extended position in solid lines and partially extended and extreme retracted positions in phantom lines.

FIG. 3 shows a left side view of the application apparatus 10 with the arm 13 in its extreme extended position in which the arm 13 is in substantially parallel alignment with the longitudinal axis of the body 12. To reach distally located body parts, the arm 13 is positioned, as shown, by turning the arm knob 20 to loosen the arm 13 and rotating the arm 13 toward the extreme extended position. The arm 13 may then be locked in position by tightening the arm knob 20 once the desired position of the arm 13 has been reached. FIGS. 5, 6, and 7 depict details of how the arm 13 may be locked and unlocked for use or change of angular position with respect to the body 12.

Figure 4:
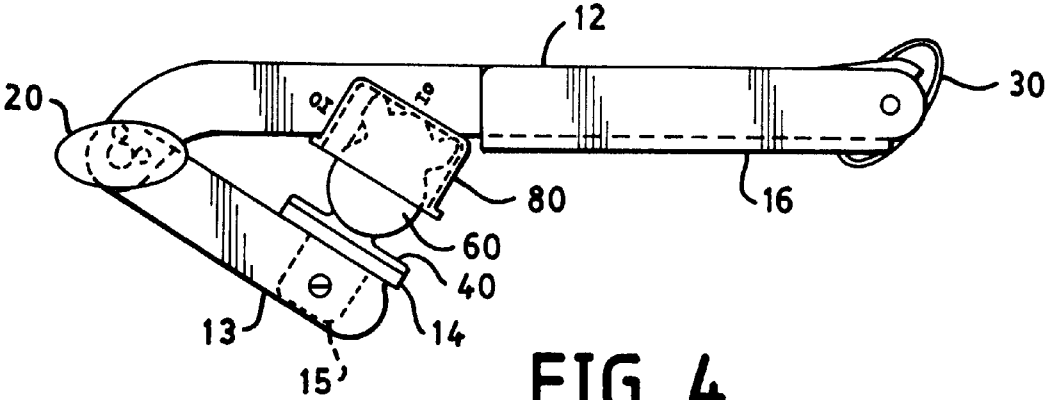
FIG. 4 shows a left side view of the embodiment in FIGS. 1 through 3 with its arm in its extreme retracted position and its handle in its extreme folded position.
Figure 8:
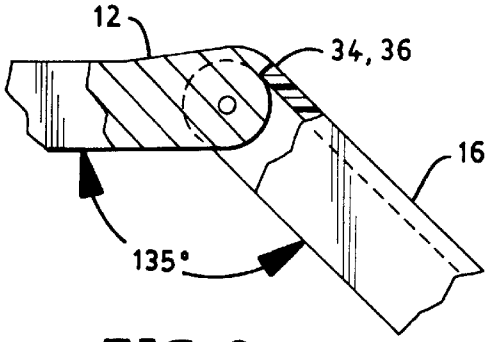
FIG. 8 shows a left side, sectional view of a handle locking assembly with the handle in its extreme open position.
Figure 10:
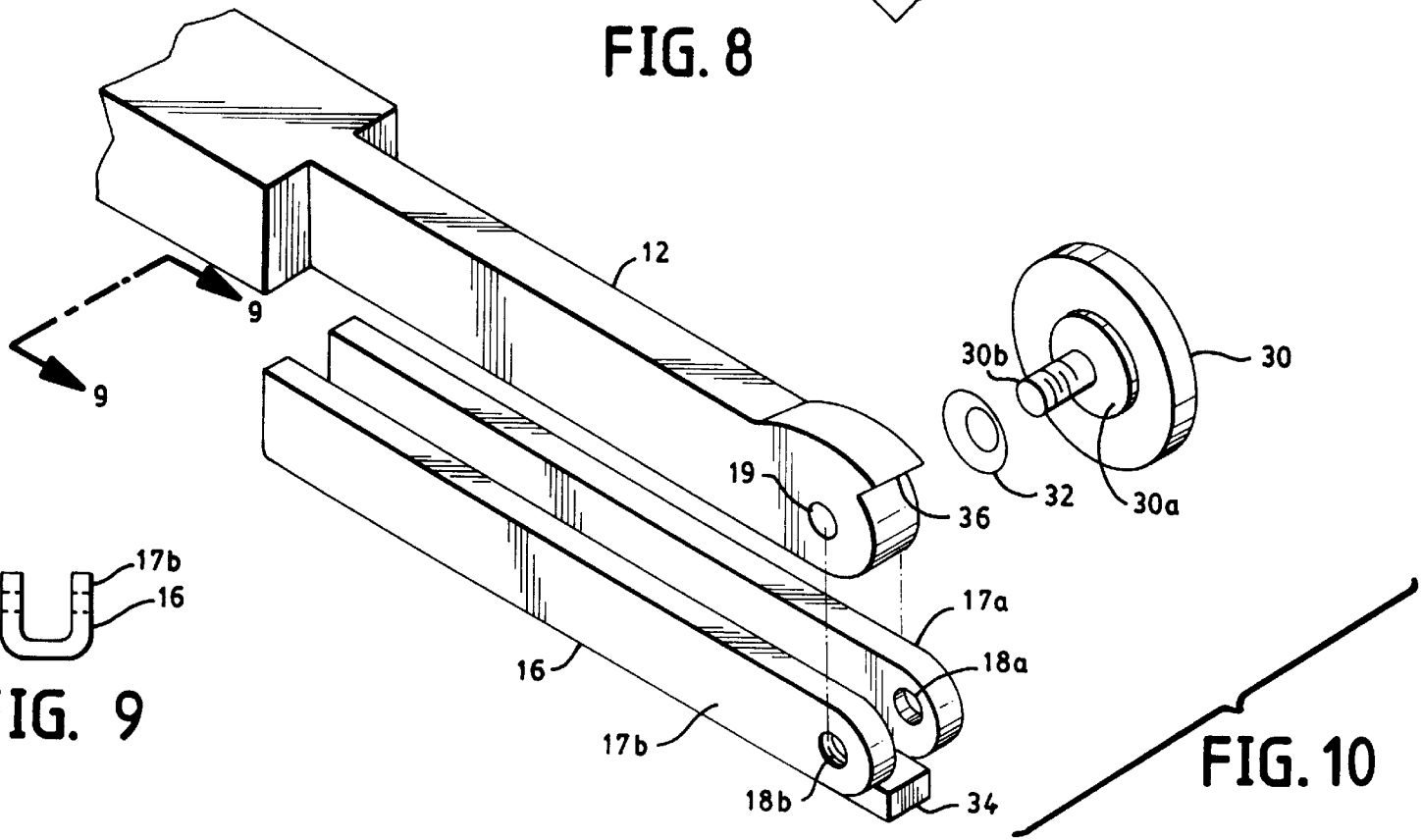
FIG. 10 shows a partial perspective, exploded view of the handle and a handle locking assembly as seen from the left side rear.
Figure 9:
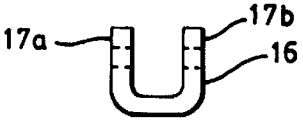
FIG. 9 shows a rear end view taken along plane 9—9 (in FIG. 10) of the handle.

FIG. 4 shows the application apparatus 10 with the arm 13 in its extreme retracted position and the handle 16 in its extreme folded position which provides for easy transportation and storage. The extreme retracted position of the arm 13 is achieved in the embodiment shown by loosening the arm knob 20, which threadably engages the body 12 through the arm 13, and rotating the arm 13 into its extreme retracted position in which the applicator pad 60 rests in the cover 80 thereby protecting the applicator pad 60 from contamination. Furthermore, by loosening the handle knob 30, and folding the handle 16 so that it is disposed over the body 12 in its extreme folded position, and by tightening both the arm knob 20 and the handle knob 30, the application apparatus 10 is compact and conveniently stowed. FIGS. 8, 9, and 10 discussed below illustrate details of how the handle 16 may be locked and unlocked for use or change of position.

FIGS. 5, 6 and 7 show details of the mechanisms employed in the embodiment shown to permit the arm 13 to be alternately loosened and tightened for movement and selective locking. FIGS. 5 and 6 in particular depict an arm locking assembly 6. As FIG. 5 illustrates, the arm knob 20 has a friction seat 20*a* and a threaded rod 20*b* which extends through a hole in the back end of the arm 13 and threadably engages a threaded hole in the forward end of the body 12. The threaded rod 20*b* is slidably received in and through the hole in the back end of the arm 13 so that the locking of the arm 13 can be achieved by friction alone between the back end of the arm 13 and the forward end of the body 12 and the friction seat 20*a* as they are drawn together by the threading of the arm knob 20 into the threaded hole at the forward end of the body 12. However, the embodiment shown further employs a spring plunger and detent system which assists in the locking of the arm 13, but which also alerts the user of the apparatus when predetermined, ergonomically advantageous positions for the arm 13 have been reached. FIG. 6 shows a top sectional view of the arm locking assembly 6 with the spring plunger and detent system. The spring plunger and detent system includes a spring plunger 22 which includes a ball 22*a* normally biased in the direction of detents 24 by a spring 22*b*. As FIG. 6 makes clear, the spring plunger 22 and its ball 22*a* are carried by the body 12 at its forward end while the detents 24 are disposed in the arm 13 in at least two places that correspond to optimal locking positions of the arm 13 with respect to the body 12. As the user rotates the arm 13, with the arm knob 20 loosened just enough to frictionally disengage and allow the movement of the arm 13, into various positions about the threaded rod 20*b* (i.e., the pivot point or axis of the arm 13), the ball 22*a* freely rolls along the surface of the arm 13 in a path of fixed radius having as its center the longitudinal axis of the threaded rod 20*b* and is biased into a detent 24 as the ball 22*a* comes into alignment with a detent 24. As is well-known with such plunger and detent systems, a "clicking" sound and a slight resistance to the movement of the arm 13 are produced as the ball 22*a* comes to rest in a detent 24 and the user is made aware that a predetermined position for the arm 13 has been reached. The arm knob 20 can be tightened down to prevent the movement of the arm 13 once the desired position has been reached. It will be appreciated that the number of positions in which the arm 13 can be locked by friction is not limited by the number of detents 24 along the surface of the arm 13; that is, the arm 13 can be locked by friction anywhere along its path of angular displacement. It will also be apparent that it is immaterial which of the body 12 and the arm 13 contains the ball 22*a* and the spring 22*b* and which contains the detents 24 so long as the components are aligned to cooperate as described. Furthermore, numerous mechanisms will occur to those of ordinary skill to achieve the positioning and locking functions in substantially the same way as those heretofore describe and such mechanisms are regarded by the inventor as within the scope and spirit of this invention since the function described is more important than the particular manner in which that function is achieved.

FIG. 7 illustrates the arm 13 in one of two optimal locking positions; that is, the extreme extended position, and further illustrates in phantom lines, the other of two optimal locking positions and the extreme retracted position. The optimal use position of the arm 13 shown in phantom lines places the arm 13 at substantially a 135° angle with respect to the longitudinal axis of the body 12. The extreme extended position of the arm 13 places the arm 13 substantially parallel to the longitudinal axis of the body 12. Although detents 24 could be placed at any or as many locations on the arm 13 as desired, experimentation by the inventor has determined that the two optimal use positions described and depicted are ergonomically advantageous to users of the application apparatus 10. There may or may not be a detent 24 corresponding to the extreme retracted position of the arm 13. Also, as is shown in the drawings, the body 12 may be curved at its forward end with the arm 13 pivotally attached near the end of the curved portion of the body 12; this configuration eliminates jagged edges and corners near the point of attachment between the body 12 and the arm 13 which jagged edges and corners could catch on clothing or other material, or cause discomfort or injury, when the application apparatus 10 is in use. As shown in FIG. 7, the forward end of the body 12 is shown curved at an angle corresponding to one of the previously identified optimal positions for use of the arm 13; that is, about 135°.

The applicator head 14 may be either fixedly or removably attached to the arm 13. The FIGS. depict a removably mounted applicator head 14 which is attached to the arm 13 by a bracket 15. The applicator head 14 may also be pivotally attached to the arm 13 to provide a greater number of positioning permutations. Specifically, the bracket 15 may be pivotally attached to the arm 13, the applicator head 14 may be pivotally attached to the bracket 15, and/or the clamp 40 may be pivotally attached to the head 14 to provide greater positioning versatility of the application apparatus 10.

To use the application apparatus 10 to apply sun tan lotion, for example, the lotion is applied directly to the applicator pad 60 instead of a user's hand. The applicator pad 60 is then rubbed along the parts of the body which the user desires to coat.

Although one of the objects of the invention is to prevent the user's hands from becoming contaminated with the topical solution when the application apparatus 10 is in use, a user's hands may still be so contaminated by topical solution or may become slippery for other reasons; from swimming, etc. To facilitate ease of use under such circumstances, the arm knob 20 and the handle knob 30 may be elongated perpendicularly to their rotation axes to permit effective gripping and turning; the knobs 20, 30 shown in the drawings are depicted as generally elliptical in shape, for instance.

FIG. 8 depicts a partial left side sectional view of the handle locking assembly of the preferred embodiment. Preferably the handle 16 is permitted to travel a minimum of 135 degrees between an extreme folded position and an extreme open position as previously described and as seen in FIGS. 1 through 4. When the handle 16 is in the extreme open position, a tang 34 on the handle 16 contacts a stop 36 on the body 12. This can be more readily seen in FIG. 10. This tang 34 and stop 36 arrangement defines a maximum point beyond which the handle 16 cannot open, provides rigidity and eliminates the chance of the handle 16 slipping beyond a fixed point when torque tending to open the handle 16 is applied during use. Furthermore, although the drawings illustrate that the maximum angle attainable by the handle 16 with respect to the body 12 is approximately 135°, this is illustrative only and does not constitute a limitation on the scope of the invention; just as the arm 13 can be made to extend to a position in which it is substantially parallel to the longitudinal axis of body 12, so can the handle 16 be made to open to a point at which it is substantially parallel to the longitudinal axis of the body 12. Also, both the arm 13 and the handle 16 could be made so they can rotate to points beyond parallel alignment with the longitudinal axis of the body 12 to reach parts of the body or other surfaces which might otherwise be unreachable.

FIG. 9 is an end view of the handle 16 taken along plane 9—9 of FIG. 10. The handle 16 may be "U-shaped" as viewed from either end so that it can easily fold over a portion of the body 12 which is narrower than the space between the two "prongs" of the U-shape to make the application apparatus 10 as compact as possible. Specifically, the U-shaped configuration of the handle 16 defines a first wall 17*a* and a second wall 17*b* of the handle 16 between which the body 12 is received when the handle 16 is in the extreme folded position.

FIG. 10 is a partial perspective view depicting how the handle 16 is attached to the body 12 of the application apparatus 10. The handle knob 30 has a pressure seat 30*a* and a threaded rod 30*b* which extends through a first hole 18*a* in the second end of the handle 16, a hole 19 in the rear end of the body 12, and a threaded hole 18*b* in the handle 16 which threaded hole 18*b* is in alignment with the hole 18*a* in the handle 16. The holes 18*a* and 19 are preferably smooth bores so that the locking of the handle 16 can be achieved by friction alone between the rear end of the body 12 and the walls 17*a* and 17*b* of the handle 16 that accommodate the body 12 as the walls 17*a* and 17*b* are drawn toward one another by the threading of the handle knob 30 into the threaded hole 18*b*. Optionally, a spring washer 32 may be fitted over the threaded rod 30*b* to prevent the unintended loosening of the handle knob 30 when the application apparatus 10 is in use. In a similar manner described in connection with the arm 13 above, the handle knob 30 is loosened when a change in angular position of the handle 16 with respect to the body 12 is desired; when the desired position has been attained, the handle knob 30 is tightened to retain the handle 16 in place by friction. Although not illustrated in the drawings, a spring plunger and detent mechanism of the type described in connection with the arm locking assembly 6 could be employed in connection with the handle 16. In addition, as with the arm locking assembly 6, numerous mechanisms will occur to those of ordinary skill to achieve the positioning and locking functions of the handle 16 and such mechanisms are regarded by the inventor as within the scope and spirit of this invention.

Figure 11:
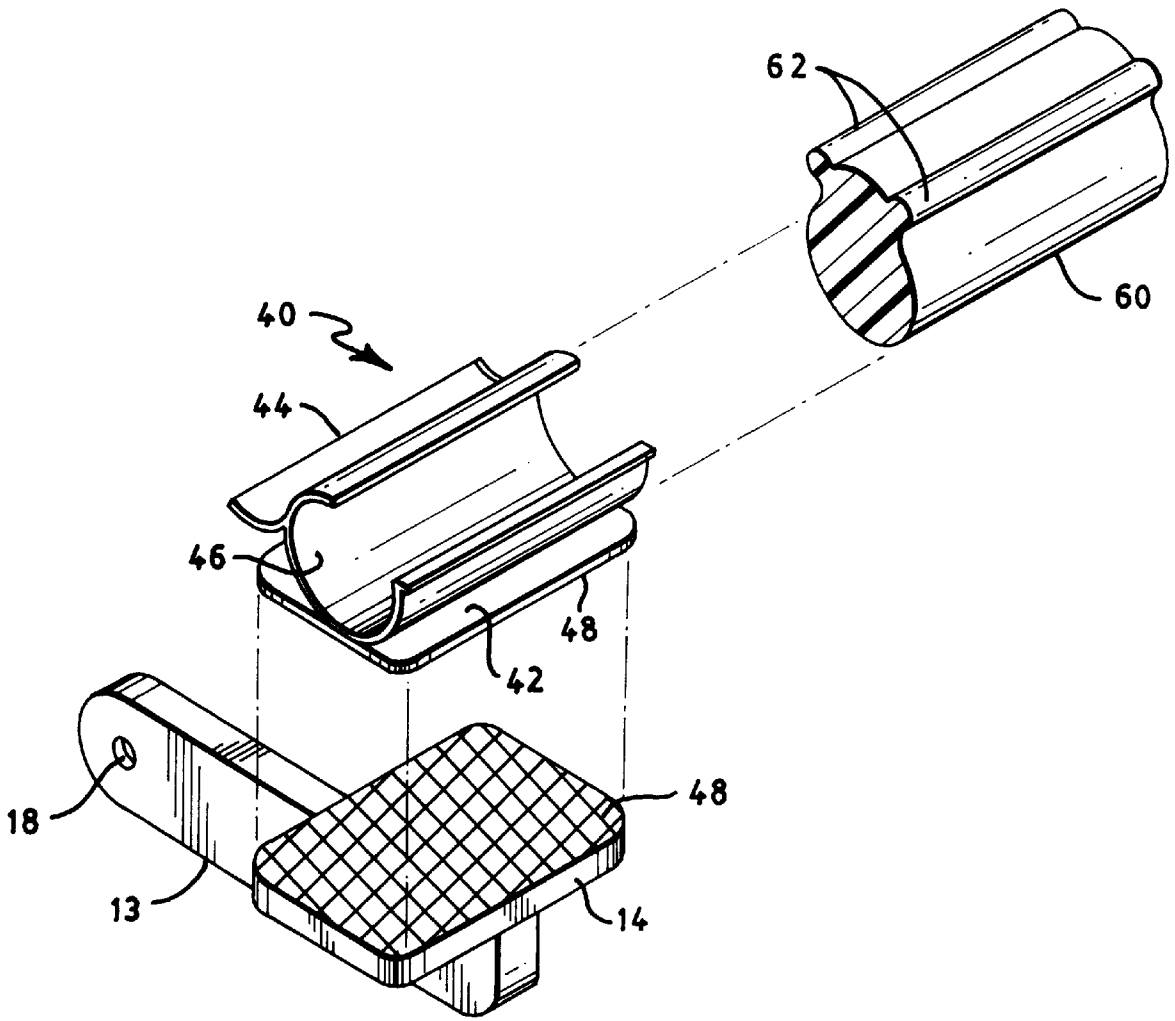
FIG. 11 shows a perspective view of the head, clamp, and applicator assembly of an embodiment.

Two illustrative alternative means for retaining an applicator pad 60 on the applicator head 14 are disclosed, although numerous equivalent mechanisms for so retaining the applicator pad 60 will readily occur to those of ordinary skill in the art. FIG. 11 shows a perspective view of the applicator head 14 of one embodiment. A clamp 40, made from a resilient material such as plastic, has a tongue 44, a base 42 and a flexible housing 46. The base 42 may be attached to the applicator head 14 by adhesive, hook and loop fasteners (e.g. Velcro® Brand hook and loop fasteners), snap interlocking parts, screws, nuts and bolts, clips, rivets or any other suitable fasteners. While the clamp 40 may be attached to the applicator head 14 permanently with an adhesive, for example, it is preferable that it be attached securely, but removably thereto. Alternatively, the clamp 40 and the applicator head 14 can be molded in one piece thereby avoiding the use of any adhesives or fasteners, but such a configuration would sacrifice removability and may complicate manufacture. An applicator pad 60 is inserted into the clamp 40 by flexing the housing 46 open by pushing on the tongue 44 to permit the insertion of the applicator pad 60. When the applicator pad 60 is in the proper position within the clamp 40, the tongue 44 is released to permit the housing 46 to return to its at-rest position thereby clamping the applicator pad 60 in place. Removal of applicator pads 60 is achieved by performing the opposite operation as inserting applicator pads 60.

Although not necessary, the applicator pad 60 may have a ridge 62 in at least two places along its surface to allow more efficient application and distribution of topical solutions placed thereon. Based on experiments, the applicator pad 60 is preferably made from S-90 white reticulated polyurethane open cell foam for best results in applying topical solutions.

Figure 12:
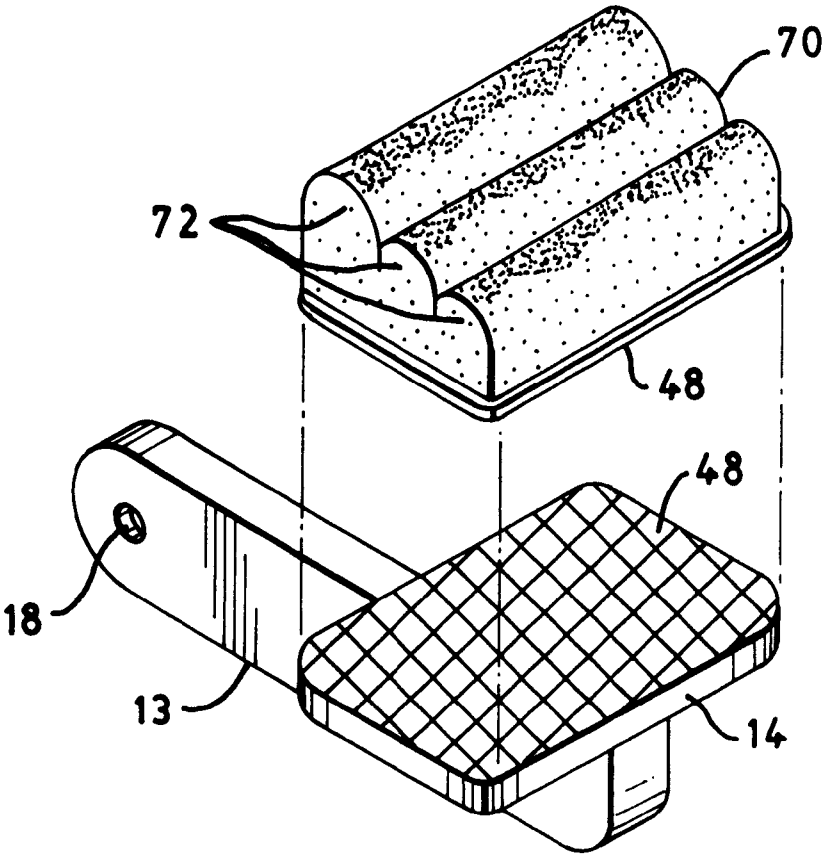
FIG. 12 shows a perspective view of the head and applicator assembly of an alternative embodiment.

Another alternative means for retaining an alternative applicator pad 70 on the applicator head 14 is illustrated in FIG. 12. The particular applicator pad 70 shown has a tapered step 72 in at least three locations for optimum application of topical solutions and is attached directly to the applicator head 14. Preferably the applicator pad 70 shown has a peelable backing containing adhesive 48 on its underside for placement on the applicator head 14 which may also have adhesive 48 thereon. This permits changing of the applicator pad 70 by merely peeling it off the applicator head 14 and replacing it with a new one.

In a third alternative embodiment, the applicator head 14 may have the applicator pad 70 permanently attached thereto and the combination of the applicator head 14 and the applicator pad 70 may be replaced in its entirety when necessary by removing it from the arm 13. In such an embodiment, the applicator head 14 would obviously have to be removably attached to the arm 13 in much the same manner depicted in FIG. 2 and discussed previously. Furthermore, in such a configuration, the combination of the applicator head 14 and the applicator pad 70 would be a disposable element that would have to be replaced in its entirety.

The main components of the topical solution application apparatus 10 are preferably fabricated from plastic by injection molding. The cover 80 is preferably integrally molded with the body 12, but can also be separately fabricated and removably attached to the body 12 by screws or snaps, for example.

The foregoing is considered to be illustrative only of the principles of the invention. Furthermore, since numerous modifications and changes will readily occur to those skilled in the art, it is not desired that the foregoing limit the invention to the exact construction and operation shown and described. Accordingly, all suitable modifications and equivalents may be resorted to that appropriately fall within the scope of the invention. Other embodiments therefore will occur to those skilled in the art and are within the scope of the following claims:

What is claimed is:

1. A topical solution application apparatus for applying topical solutions to a surface comprising:

an elongated body having a rear end and a forward end;

an elongated arm having a back end and a front end, said arm being pivotally attached at its back end to said forward end of said body and movable about its point of attachment to said body between an extreme extended position and an extreme retracted position, said arm further having an applicator head attached to its front end;

means disposed on said applicator head for retaining an applicator pad;

an applicator container disposed on said body for receiving and protecting the applicator pad from contamination when said arm is in its extreme retracted position; and arm locking means engaging said arm and said body for locking said arm in at least one of (i) its extreme extended position, (ii) its extreme retracted position and (iii) a position between its extreme extended and retracted positions.

2. The apparatus of claim 1 wherein said arm locking means is such that said arm may be locked in at least both of its extreme extended position and its extreme retracted position.

3. The apparatus of claim 1 further comprising a handle having a first end and a second end, said handle being pivotally attached at its second end to said rear end of said body and movable about its point of attachment to said body between an extreme open position and an extreme folded position.

4. The apparatus of claim 3 further comprising handle locking means engaging said handle and said body for locking said handle in at least one of (i) its extreme open position, (ii) its extreme folded position and (iii) a position between its extreme open and folded positions.

5. The apparatus of claim 3 wherein said handle is of generally U-shaped construction as viewed from either of said first and second ends of said handle, the U-shaped configuration defining a first wall and a second wall of said handle between which said body is received when said handle is in said extreme folded position.

6. The apparatus of claim 5 wherein said handle locking means includes a handle knob having a pressure seat and a threaded rod portion, said threaded rod portion extending through a first smooth bore through one of said first and second walls of said handle, proximate said second end of said handle, and a smooth bore in said rear end of said body and threadably engaging a threaded second bore in the other of said first and second walls of said handle, opposite said first smooth bore, so that when said threaded rod portion of said handle knob is threaded into said threaded second bore said pressure seat urges whichever of said first and second walls includes said first smooth bore toward the other of said first and second walls so that said rear end of said body is squeezed between, and frictionally engages, each of said first and second walls of said handle thereby locking said handle in a fixed position relative to said body.

7. The apparatus of claim 1 wherein said means disposed on said applicator head for retaining the applicator pad comprises a clamp attached to said applicator head.

8. The apparatus of claim 7 wherein said clamp comprises a base for mounting said clamp to said applicator head; a housing for removably receiving and retaining the applicator pad; and a tongue for opening said housing for alternately receiving and removing the applicator pad.

9. The apparatus of claim 1 wherein said means disposed on said applicator head for retaining the applicator pad comprises an adhesive.

10. The apparatus of claim 1 wherein said applicator head is pivotally mounted to said arm so that the angle between said head and said arm can be adjusted for greater versatility in using the apparatus.

11. The apparatus of claim 1 wherein said arm locking means comprises an arm knob having a friction seat and a threaded rod portion, said threaded rod portion extending through a smooth bore in said back end of said arm and threadably engaging a threaded hole in said forward end of said body so that when said threaded rod portion is threaded into said threaded hole, said back end of said arm is clamped between said friction seat and said forward end of said body so that said arm is held in a fixed position by friction.

12. The apparatus of claim 11 wherein said arm locking means further comprises a spring plunger and detent system including a spring in one of said arm and said body biasing a ball in the direction of at least one detent in the other of said arm and said body, said at least one detent being disposed radially about the pivot axis between said arm and said body and in alignment with the path traversed by said ball as said arm is pivoted with respect to said body so that said ball is biased into said at least one detent by said spring when said ball is in alignment with said at least one detent thereby locking said arm in position with respect to said body.

13. A topical solution application apparatus for applying topical solutions to a surface comprising:

an elongated body having a rear end and a forward end;

an elongated arm having a back end and a front end, said arm being pivotally attached at its back end to said forward end of said body and movable about its point of attachment to said body between an extreme extended position and an extreme retracted position and selectively lockable in at least one of (i) its extreme extended position, (ii) its extreme retracted position and (iii) a position between its extreme extended and retracted positions, said arm further having an applicator head attached to its front end;

an applicator pad attached to said applicator head; and an applicator container disposed on said body for receiving and protecting said applicator pad from contamination when said arm is in its extreme retracted position.

14. The apparatus of claim 13 further comprising a handle having a first end and a second end, said handle being pivotally attached at its second end to said rear end of said body and movable about its point of attachment to said body between extreme open and folded positions.

15. The apparatus of claim 14 wherein said handle is selectively lockable in at least one of (i) its extreme open position, (ii) its extreme folded position and (iii) a position between its extreme open and folded positions.

16. A topical solution application apparatus for applying topical solutions to a surface comprising:

an elongated body having a rear end and a forward end;

an elongated arm having a back end and a front end, said arm being pivotally attached at its back end to said forward end of said body and movable about its point of attachment to said body between an extreme extended position and an extreme retracted position, said arm further having an applicator head attached to its front end;

an applicator pad attached to said applicator head;

an applicator container disposed on said body for receiving and protecting said applicator pad from contamination when said arm is in its extreme retracted position; and a handle having a first end and a second end, said handle being pivotally attached at its second end to said rear end of said body and movable about its point of attachment to said body between an extreme open position and an extreme folded position.

17. The apparatus of claim 16 wherein said arm is selectively lockable in at least one of (i) its extreme extended position, (ii) its extreme retracted position and (iii) a position between its extreme extended and retracted positions and wherein said handle is selectively lockable in at least one of (i) its extreme open position, (ii) its extreme folded position and (iii) a position between its extreme open and folded positions.

* * * * *